United States Patent [19]

Smith

[11] 3,945,389

[45] Mar. 23, 1976

[54] FOLDABLE WALKER

[76] Inventor: Alfred A. Smith, 13114 Margate St., Van Nuys, Calif. 91401

[22] Filed: May 11, 1973

[21] Appl. No.: 359,354

[52] U.S. Cl. ..... 135/45 A
[51] Int. Cl.[2] ..... A61H 3/00
[58] Field of Search ..... 5/114, 314, 315 B, 315 R; 108/160; 135/45 A; 248/167, 434, 436; 297/5, 6; 403/85, 164

[56] References Cited

UNITED STATES PATENTS

| | | | |
|---|---|---|---|
| 1,432,465 | 10/1922 | Johnson | 5/315 B |
| 1,869,693 | 8/1932 | Hourd | 108/160 |
| 2,270,217 | 1/1942 | North | 108/160 |
| 2,771,089 | 11/1956 | Magida | 135/45 A |
| 2,778,664 | 1/1957 | Herbenar | 403/164 |
| 3,442,276 | 5/1969 | Edwards et al. | 135/45 A |
| 3,658,079 | 4/1972 | Block | 135/45 A |
| 3,688,789 | 9/1972 | Bunch | 135/45 A |
| 3,783,886 | 1/1974 | Thomas | 135/45 A |

*Primary Examiner*—Paul R. Gilliam
*Assistant Examiner*—David H. Corbin
*Attorney, Agent, or Firm*—George F. Smyth

[57] ABSTRACT

A collapsible walker in which gate legs are each pivotally mounted in bearings positioned at either end of a cross brace with the gate legs mounted in the bearings for rotation between an open position with the gate legs positioned generally transversely of the cross brace and a collapsed position with the gate legs folded against the cross brace. Corner braces are positioned adjacent to the bearings to provide rigid bracing support between the gate legs and the cross brace when the gate legs are in an open position, with the corner braces being movable to permit rotation of the gate legs to a collapsed position.

Detent means are provided with tab release means therefor.

The movement of the corner braces during movement of the gate legs may be determined by guide slots. Frictional means may be provided to resist opening or closing of movement of the gate legs.

The bearings in which the gate legs are mounted may include a self-lubricating plastic sleeve with a tubular member on each of the gate legs mounted within the plastic sleeve.

18 Claims, 10 Drawing Figures

FIG. 1
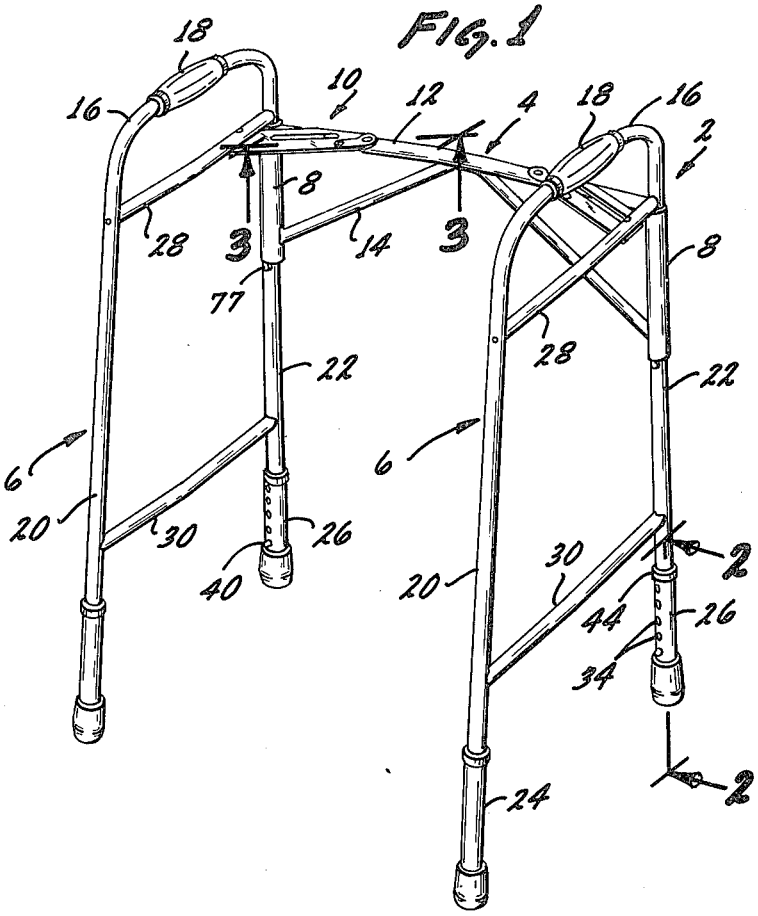
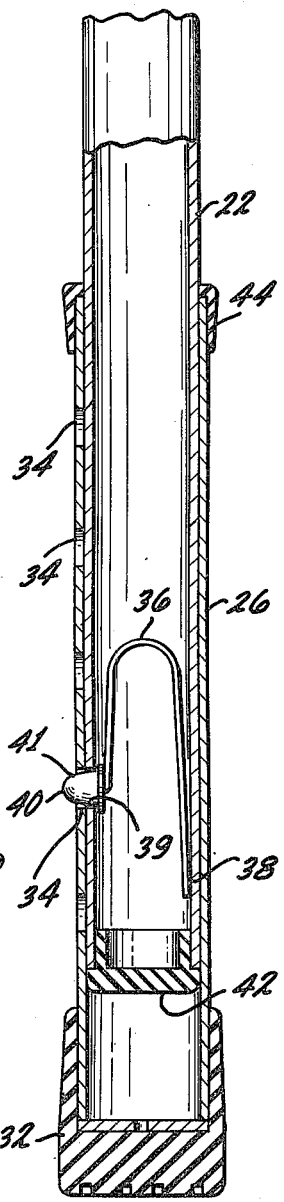
FIG. 2
FIG. 4
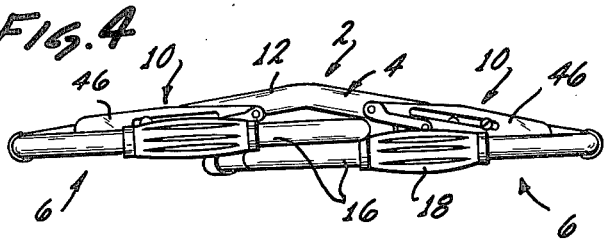
FIG. 3
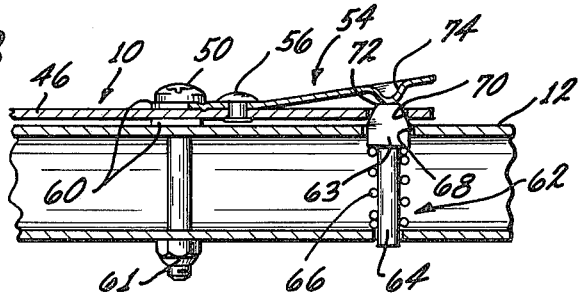

FOLDABLE WALKER

BACKGROUND OF THE INVENTION

Due to great strides in medicine within the past few decades, there has been a considerable increase in the average life expectancy. Concurrently, there has been a considerable change in the age profile of the general population in advanced countries which have felt the impact of improved drugs and medical procedures. Thus, the population of elderly people in advanced countries is now much higher than it was previously.

With increased medical knowledge, there has also been an increased in the life expectancy of human beings who suffer from disabling diseases or injuries caused by birth trauma. For example, humans afflicted with cerebral palsy now lead longer and more useful lives and the life expectancy of people suffering from muscular dystrophy has also been extended.

The increased number of elderly and disabled people in the population has created a need for walking aids of various types. Such walking aids generally have a rigid frame construction with a plurality of legs which support the walking aid in an upright position. In usage, the walking aid is gripped for support and is lifted slightly or slid over a horizontal surface during the forward movement by the user. After being slid, for example, in a forward direction, the user can then lean on the aid while taking several more steps and the walking aid may then be slid to a new position, etc.

Walking aids are a necessity to many invalids and must accompany them wherever they go. Thus, a walking aid should be capable of being folded to a flat position during shipment or storage. Since the folding or unfolding of a walking aid will frequently have to be accomplished by the invalid himself, without outside assistance, the folding mechanism should be such that it can easily be operated by an elderly or disabled person without the need for fine muscular coordination. For example, on entering an automobile, the invalid will generally back into the automobile while supporting himself with the walking aid. Once seated, the walking aid will then be folded to a collapsed position and lifted into the automobile for carrying. On leaving an automobile, the reverse operation will have to be performed with the invalid first lifting the walking aid to a position outside the automobile, and unfolding the walking aid to an extended or operating position, and lastly, raising himself to an upright position by using the walking aid as a support.

If the mechanism for folding the walking aid to a collapsed position requires fine muscular coordination, the unfortunate user may not be able to get the walking aid into an automobile because he is unable to fold it to a collapsed position. Conversely, if the user is unable to operate the mechanism for unfolding the walking aid, he may be literally a prisoner within his own car and be unable to leave without assistance from an outsider in unfolding the walking aid. Since a walking aid may be folded and unfolded many times depending on the daily activities of the user, it is extremely important that the folding and unfolding mechanism not require fine muscular coordination since this would make the walking aid virtually unusable by many elderly and disabled persons.

As essential characteristic for a walking aid is that it provide a firm support for the user. An elderly or disabled person using the walking aid may have a poor sense of equilibrium and a genuine fear of falling. Given these circumstances, nothing can be more unnerving than a walking aid which feels unstable. Walking aids of the foldable or collapsible type frequently develop a certain feeling of looseness through wear at joints or pivot points resulting from the constant folding and unfolding of the walking aid. Thus, it would be desirable to provide a foldable or collapsible walking aid which does not develop looseness during continued usage and continues to provide stable support for the user.

One form of collapsible or foldable walking aid which has been previously used is the so-called "gate leg walker" in which a pair of gate legs are each pivotally interconnected to a cross brace with the gate legs being rotatable from an open position substantially tranverse to the cross brace to a collapsed position in which the gate legs are folded against the cross brace. Previous gate leg walkers have not been generally satisfactory because they are difficult to operate by an elderly or disabled person lacking fine muscular coordination and they are unsturdy and have a tendency to wobble after continued usage. This contributes to a feeling of insecurity by the user and could, in an extreme case, cause the user to fall and injure himself.

Further, previous gate leg walkers also suffer from the disadvantage that the space provided for the user between the gate legs is not sufficiently open and may, therefore, interfere with the normal usage of the walker. For example, the use of the walker aid as a bathroom assist is extremely important to an elderly or disabled person. However, if the space provided between the legs of the walker is not sufficiently open and unobstructed, it may be impossible to slide the walker over a standard toilet bowl with the walker legs positioned on either side of the bowl. In this instance, the walker will not be usable as a bathroom assist which might make it impossible for the user to perform his normal bodily functions with safety and convenience.

SUMMARY OF THE INVENTION

In providing a solution to the aforementioned problems, I have devised a collapsible walker in which a pair of gate legs are each pivotally mounted in bearings positioned at the extremities of a cross brace. The gate legs are rotatable between an open position with the gate legs positioned generally transversely of the cross brace to a collapsed position with the gate legs folded against the cross brace. Corner braces are positioned adjacent each of the bearings with the corner braces providing rigid bracing support between the gate legs and the cross brace when the gate legs are in an open position. However, the corner braces are movable to permit easy rotation of the gate legs to a collapsed position for shipment and storage of the walker.

Each of the corner braces may be pivotally mounted on one of the gate legs with each corner brace being movable with respect to the cross brace during movement of the gate legs to a collapsed position. When the gate legs are in an open position, the corner braces are interlocked with the cross brace to provide bracing support between the cross brace and each of the gate legs.

With the gate legs in an open position, the corner braces may each act as a strut between one of the gate legs and the cross brace. The function of the corner braces, in conjunction with a pivotal mounting between the corner brace and the gate leg, provides triangular three point support for each gate leg. The three point support for each of the gate legs may, thus, include the mounting of a corner brace to the gate leg, the interlocking connection between the corner brace and the cross brace, and the pivitol mounting between the gate leg and the cross brace. The three point support provides a very strong and rigid supporting structure for maintaining the gate legs in a fixed position with respect to the cross brace when the gate legs are in their open position.

To provide supporting engagement between the corner braces and the cross brace, detents may be provided which are carried by the cross brace in engagement with the corner braces. When the gate legs are in an open position, apertures in the corner braces are positioned to receive the detents, with means provided to move the detents out of the apertures to unlock the corner braces when it is desired to move the gate legs to a collapsed position.

Unlike many previous walkers which require fine muscular coordination on the part of the user, the walker of the present invention may employ means to move the detents out of the apertures, which includes a release tab having a relatively large, easily accessible pushing surface. In actuating the release tab, all that is necessary is to exert a force against the pushing surface which can be easily accomplished by a handicapped or aged person.

During usage, there may be some tendency for the aperture surfaces to become worn. Since this would cause some instability in the walker, the detent surfaces which engage the apertures are preferably shaped to provide self-centering of the detents with respect to the apertures when the gate legs are in an open position. Thus, even if the aperture surfaces become worn, the detents will firmly seat on the aperture surfaces.

DESCRIPTION OF THE DRAWINGS

In the drawings, which are merely illustrative of an embodiment of the invention:

FIG. 1 is a pictorial view of a collapsable gate leg walker of the invention with the gate legs in an open position;

FIG. 2 is a sectional view taken along the line 2—2 of FIG. 1 to illustrate the manner in which the feet of the gate leg may be raised or lowered depending upon the height of the user;

FIG. 3 is a sectional view taken along the line 3—3 of FIG. 1 illustrating the manner in which the corner brace is interlocked with the cross brace with the gate legs in an open position to fix the position of the gate legs with respect to the cross brace;

FIG. 4 is a top view of the collapsable walking aid of FIG. 1, illustrating the gate legs in a collapsed or closed position with the gate legs folded against the cross brace;

DETAILED DESCRIPTION

Figure 5:
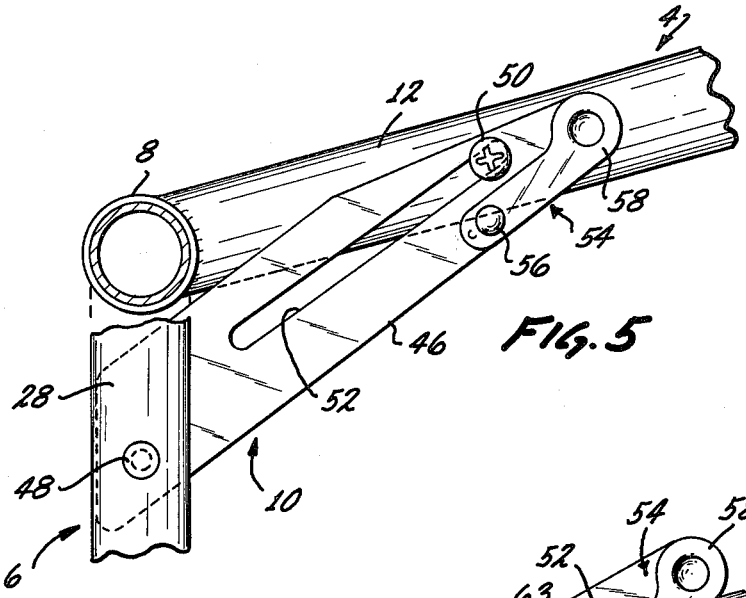
FIG. 5 is a top detail view showing the position of a corner brace with respect to a gate leg and the cross brace when the gate leg is in an open position.

FIG. 1 illustrates a collapsable walking aid 2 having a cross brace 4 and a pair of gate legs 6 which are each pivotally supported in bearings 8 carried by the cross brace. The gate legs 6 are each maintained in an open position, as shown in FIG. 1, by means of corner braces 10 which form an interlocking connection with a transverse member 12 of the cross brace 4. The outer extremities of the transverse member 12 are each joined to one of the bearings 8 adjacent to its upper extremities. Diagonal members 14 joined to the transverse member 12 extend downwardly and outwardly to join with the bearings 8 adjacent the lower extremities of the bearings. The bearings 8 are, thus, rigidly supported at either of their ends by connection to the transverse member 12 and to a diagonal member 14.

The gate legs 6, as illustrated, each have a generally U-shaped configuration in which a rearward leg 20 and a forward leg 22 are joined together by a central member 16. The central member 16 may include handgrips 18 or similar means which may be grasped by the user. The rearward legs 20 are each joined at their bottoms to a rearward foot 24 while the forward legs 22 are each joined to a forward foot 26. The rearward feet 24 and forward feet 26 are designed to contact a supporting surface such as the floor of a building, the surface of the earth, etc. As will be described, the rearward and forward feet, 24 and 26, are adjustable to vary the height of the central member 16 and handgrips 18 to suit the height of the user.

The rearward legs 20 and forward legs 22 are braced by means of upper braces 28 and lower braces 30 which each extend between a forward and rearward leg. By virtue of the upper and lower braces, 28 and 30, and the generally U-shaped configuration of the gate legs 6 provided by the central member 16 and the rearward and forward legs, 20 and 22, each of the gate legs is very rigid in its construction. This is an important consideration since the gate legs 6 are subjected to a variety of forces during usage which will vary depending upon the movement of the user at a particular time.

Turning to FIG. 2, which is a sectional view taken along the line 2—2 of FIG. 1, one of the forward legs 22 is slidable retained within the forward foot 26 which has a plurality of apertures 34 positioned axially along the foot. A pin or detent 40 carried by a spring 36 mounted within the forward leg 22 extends through an aperture 39 in the forward leg. The spring 36 may be secured to the forward leg 22 at a spring mounting point 38 by any suitable means, such as brazing.

As shown, the pin 40 is in engagement with one of the apertures 34 in the forward leg 22 to fix the height of the forward leg with respect to the foot 26. By depressing the pin 40, the forward leg 22 may be raised or lowered with respect to the forward foot 26 by sliding the leg up or down until the pin engages the next aperture 34, etc.

A tip 32, which may be formed of rubber or other suitable material, may be secured to the lower end of the forward foot 26 to provide frictional engagement of the foot with a supportive surface contacted by the tip. A slide member 42, which may be formed of plastic or similar material, is positioned on the lower end of the leg 22 and engages the inner surface of the foot 26. Similarly, a cap 44 formed of plastic or a similar material, is positioned at the upper end of the foot 26 in engagement with the outer surface of the leg 22. The contact of the cap 44 with the outer surface of leg 22 and the contact of the slide member 42 with the inner surface of the foot 26 provides a firm sliding engagement of the leg with the foot.

The pin 40, as illustrated, has a conical or curved surface 41 which engages the interior surface of an aperture 34. Due to its curvature, the contact area provided by the surface 41 will vary with respect to the degree of penatration of the pin 40 into an aperture 34. Thus, if the surfaces of the apertures 34 should become worn, through usage, the surface 41 provides a self-centering function for the pin 40 by providing a greater contact surface as the internal diameter of the aperture is enlarged.

Figure 6:
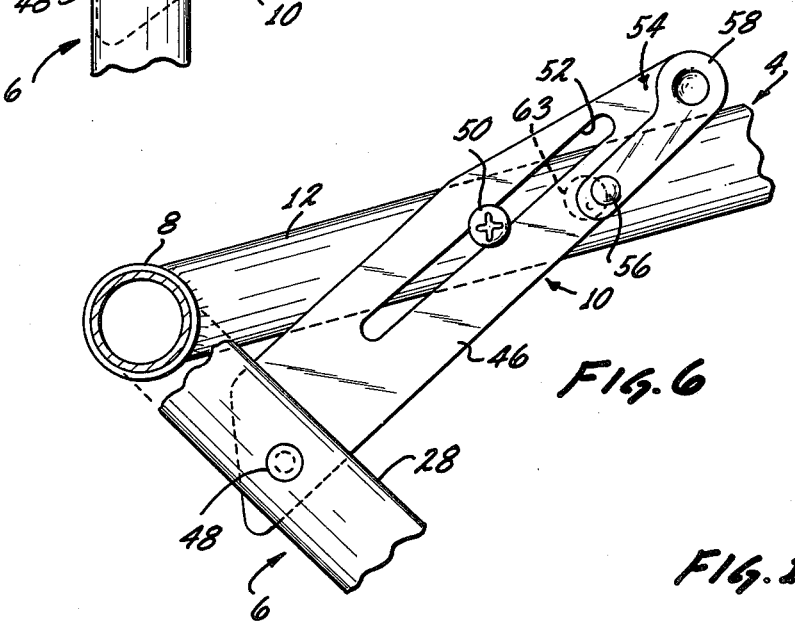
FIG. 6 is a top detail view, similar to FIG. 5, illustrating the position of the corner brace during movement of the gate leg between its open and its collapsed position.
Figure 7:
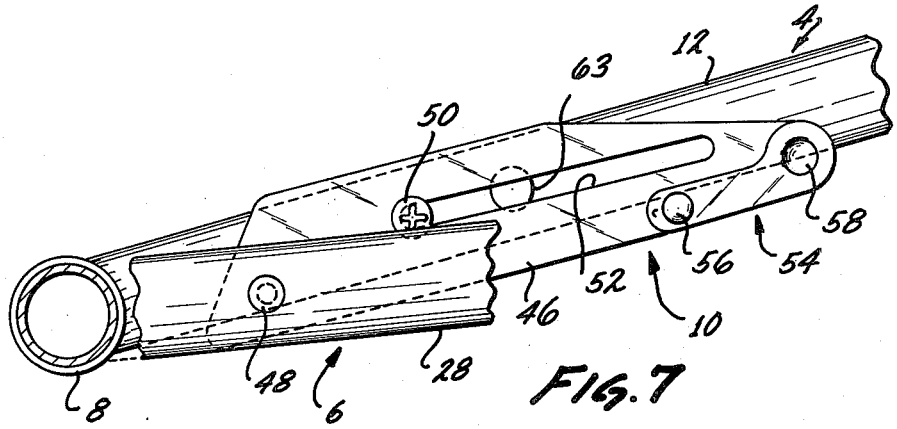
FIG. 7 is a top detail view, similar to FIGS. 5 and 6, showing the position of the corner brace when the gate leg has been moved to a collapsed position with respect to the cross brace.

The manner in which the corner braces 10 are secured to the cross brace 4 is illustrated in detail in FIG. 3, which is taken along the line 3—3 of FIG. 1. The corner braces 10 each include a plate member 46 which, as shown in FIGS. 5–7, is pivotally supported with respect to one of the upper braces 28 by a pivot pin 48. A guide pin 50 secured to the transverse member 12 engages a guide slot 52 defined in the plate member 46. A pair of plastic washers 60 or other frictional means are secured to the guide pin 50 and are positioned on either side of the plate member 46. The guide pin 50 may be secured to the transverse member 12 by any suitable means, such as a nut 61 which engages exterior threads on the guide pin. By tightening the nut 61, the plastic washers 60 are pressed against either side of the plate member 46 to provide frictional resistance to sliding movement of the plate member. The frictional resistance provided by the plastic washers 60 is advantageous when, for example, the gate legs 6 are in their collapsed position shown in FIG. 4 since the resistance tends to prevent the movement of the gate legs to an open position. Thus, the walker may be carried and moved about more easily with the gate legs 6 in a collapsed position.

When the gate legs 6 are in an open position, as shown in FIG. 1, the corner braces 10 are interlocked with the cross brace 4. This may be accomplished through means of a detent 62 positioned within the transverse member 12. The detent 62 includes a head 63 that extends through an aperture 68 in the upper surface of the transverse member 12. The detent 62 may be biased to an upward position by a spring 66 which bears against the lower surface of the head 63 and is positioned about a shaft 64. An aperture 70 in the plate member 46 is engaged by a tapered or conical surface 72 on the detent head 63 which performs a self-centering function in fixing the detent head within the aperture 70.

During usage of the walker, the gate legs 6 will be moved between an open and a collapsed position many, many times and there will be a tendency for the inner surface of the aperture 70 to become worn with consequent enlargement of the aperture. As this occurs, there will be a tendency for the fit between the aperture 70 and the detent head 63 to become progressively loosened which will cause the gate legs 6 to wobble. The conical or tapered surface 72 on the detent head 63 serves to maintain a tight-fitting relationship between the detent head and the aperture 70, even after considerable wear and enlargement of the aperture.

Moving downwardly along the axis of the detent head 63 from its position shown in FIG. 3, it will be observed that the outer contact surface provided by the detent head becomes progressively larger due to the curvature of the surface 72. Thus, the area of the contacting surface provided by the head 63 will vary in relation to the extent of penetration of the head 63 into the aperture 70. As the aperture 70 becomes worn, the detent head 63 is advanced further into the aperture to provide a larger contacting surface and to maintain a tight-fitting engagement of the detent head with the aperture 70.

To release the corner braces 10 from interlocking engagement with the cross brace 4, a release mechanism 54 is depressed to drive the detent 62 downwardly against the spring 66. This removes the detent head 63 from the aperture 70. As illustrated in FIG. 3, the release mechanism 54 is secured to the plate member 46 by a pin 56 with a button 74 on the bottom of the release mechanism bearing against the detent head 63. With detent 62 depressed, the plate member 46 may be moved relative to the transverse member 12 to provide movement of the gate legs 6 to a collapsed position.

The walker 2 is illustrated with the gate leg 6 in a collapsed position in FIG. 4. As shown, the transverse member 12 may have a somewhat V-shaped configuration in plan view with the corner braces 10 being positioned in overlying relation to the transverse member 12 when the gate legs 6 are in their collapsed position. The walker 2 has a generally flat or compressed outline when the gate legs 6 are in a collapsed position. Moreover, the corner braces 10 are protected from being bent or otherwise damaged by the transverse member 12 whose shaped and close proximity to the corner braces shield them from damage.

The position of a corner brace 10 with respect to a gate leg 6 and the cross brace 4 is illustrated in FIG. 5 with the gate leg in its open position. As illustrated, the gate leg 6, is positioned in a generally transverse direction with respect to the cross brace 4 and is maintained in this position by the corner brace 10. The corner brace 10, together with the bearing 8 provides a triangular three point support for the gate leg 6. The three point support consists of the connection between the gate leg 6 and the cross brace 4 through the bearing with the additional two points of support provided by the corner brace 10 at the pivot pin 48 and the interconnection between the detent head 63 and the aperture 70 shown in FIG. 3.

In providing support for the gate leg 6 in its open position the corner brace 10 functions as a strut with the movement of the gate leg 6 in a clockwise direction from that shown in FIG. 5 being resisted in tension by the plate member 46. Any attempted counterclockwise movement of the gate leg 6 from its position shown at FIG. 5 is resisted in compression by the plate 46. The release mechanism 54, as described with regard to FIG. 3, provides an upwardly directed enlarged pushing surface 58 which is easily accessible to the user. The exertion of a downward force on the pushing surface 58 to depress the detent 62 from its position shown in FIG. 3 does not require fine muscular coordination and permits the movement of the gate leg 6 to a collapsed position. The provision of the large pushing surface 58 for the release mechanism 54 supplies a mechanism which can be readily used by an aged or otherwise incapacitated person who lacks fine muscular coordination.

After depressing the release mechanism 54 by exerting a force on the pushing surface 58, the gate leg 6 may be swung or pivoted to a partially collapsed position as illustrated in FIG. 6. During rotation of the gate leg 6 to the position shown in FIG. 6, the corner brace 10 undergoes a complex movement which is determined by the shape and position of the guide slot 52, the position of the guide pin 50, and the position of the pivot pin 48. As the guide pin 50 moves along the guide slot 52, the corner brace 10 slides in an upward direction from that shown in FIG. 6 while, at the same time, undergoing a rotational movement about the guide pin 50.

Turning to FIG. 7, which illustrates the gate leg 6 in a collapsed position, the continued rotational movement of the corner brace 10 in what has been illustrated as a counterclockwise direction, has brought the corner brace 10 to a position where it overlies the adjacent transverse member 12. Due to the shape and close proximity of the transverse member 12 to the corner brace 10, the corner brace is shielded by the transverse member and is thereby protected from accidental damage which might result during shipping or storage of the walker in its collapsed position. Further, due to the V-shaped general configuration of the transverse member 12, the two gate legs 6 are permitted to form almost a flat surface with one of the gate legs lying above the other and cradled within the V-shaped region defined by the transverse member. This relationship is best shown in FIG. 4.

During relative movement of the gate leg 6 with respect to the cross brace 4, the detent head 63, as shown in FIG. 7, slides against the undersurface of the plate member 46. The placement and location of the guide slot 52 is such that the inner end of the corner brace 10 moves in an arc during the movement of the gate leg 6 from its collapsed position of FIG. 7 to its open position of FIG. 5. The arc defined by the inner end of the corner brace 10 during this movement brings the aperture 70 (see FIG. 3) into alignment with the detent head 63 when the gate leg 6 reaches its open position.

Figure 8:
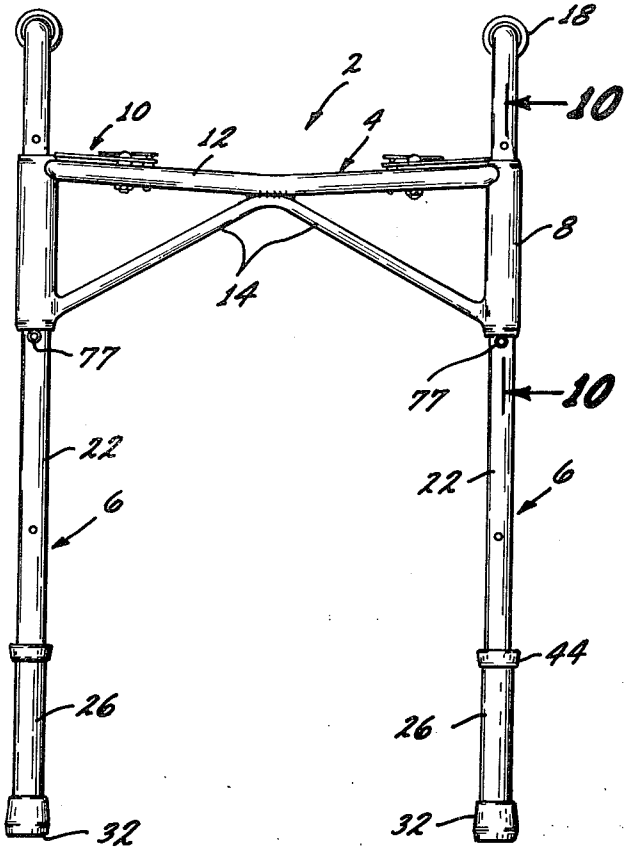
FIG. 8 is a front view of the walking aid of FIG. 1 with the gate legs in an open position.

The walking aid 2 is shown in a frontal view in FIG. 8 to illustrate the relative height of the cross brace 4 with respect to the tips 32 which contact a supportive surface and represent the lower extremities of the walker. The open region defined between the gate legs in their open position, as shown in FIG. 1, together with the height of the cross brace 4 above the supportive surface make the walker 2 useful as a bathroom assist by an invalid. In this usage, the walker 2 may be positioned so that the gate legs 6 straddle either side of a standard toilet bowl while the distance between the cross brace 4 and the supportive surface for the walker is sufficient to permit the cross brace to pass above the upper surface presented by the bowl. In this position, the walker 2 can be used to assist the user while moving to and from a sitting position.

Figure 9:
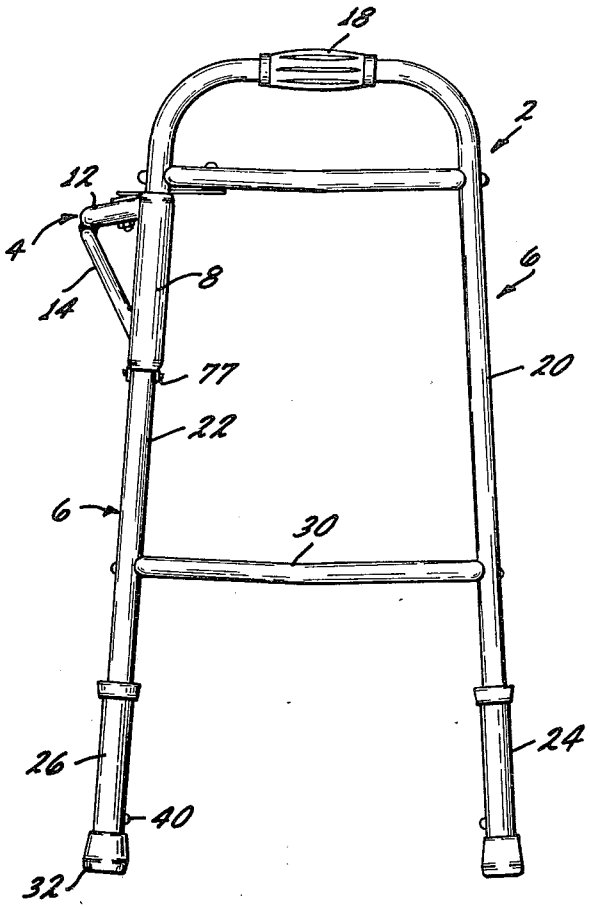
FIG. 9 is a side view of the walking aid of FIG. 1 with the gate legs in an open position.

As shown in FIG. 8 the diagonal members 14 may be conveniently formed in one piece as a V-shaped member in which the apex is inter-connected with the apex of the V-shaped transverse member 12. Turning to FIG. 9, which is a side elevational view of the walker 2, the cross brace 4 is illustrated as protruding forwardly to accommodate the movement of the gate legs 6 to a collapsed position. The V-shaped member which includes the diagonal members 14 acts as a truss in providing a rigid connection of the bearings 8 to the transverse member 12.

During long usage of the walking aid 2, the gate legs 6 will be moved many times between an open position and a collapsed position with respect to the cross brace 4. With previous gate leg walkers, this type of continued movement has created problems in that the connections between the gate legs and the cross brace eventually became loosened so that the gate legs would wobble in their open position. Many crippled or infirm persons have a poor sense of equilibrium and a fear of falling since this could result in bone breakage, a long period of confinement, and an uncertain recovery. Thus, it is necessary to both the mental security and physical well-being of the user that the gate legs 6 be firmly positioned with respect to the cross brace 4 when the gate legs are in an open position.

In previous gate leg walkers, there was frequently metal-to-metal contact at the inter-connection between the gate legs and the cross brace. With such contact, the inevitable result was a considerable amount of wear to produce loosening of the gate legs. Walking aids are frequently constructed of aluminum members to reduce their weight so that they can be easily lifted by an incapacitated or feeble person. Aluminum is a relatively soft metal and, thus, the wear resulting from metal-to-metal contact at the inter-connection between the gate legs and the cross brace is relatively rapid.

Figure 10:
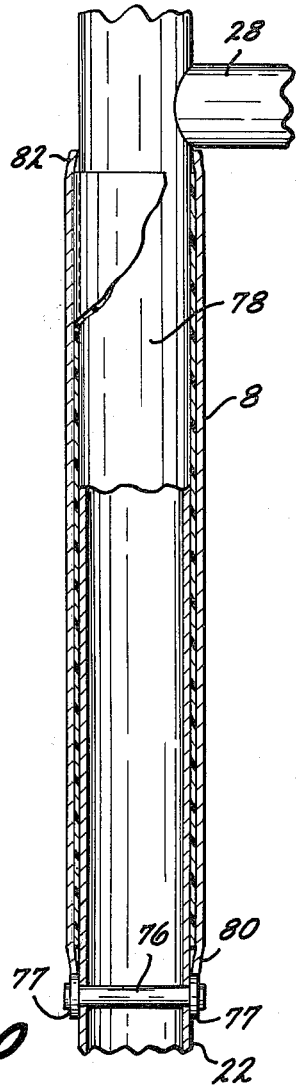
FiG. 10 is an enlarged sectional view taken along the line 10—10 of FIG. 8, illustrating the use of an elongated self-lubricating plastic sleeve for pivotally supporting a gate leg with respect to the cross brace to eliminate metal-to-metal contact between the cross brace and the gate leg.

To provide for a firm inter-connection between the gate legs 6 and the cross brace 4, I have provided a pivotal inter-connection which eliminates metal-to-metal contact. This is illustrated in FIG. 10 which is a sectional view taken along the line 10—10 of FIG. 8. As shown, the bearing member 8 may have a tubular configuration and be supported by the transverse member 12 and one of the diagonal members 14, as described with regard to FIG. 1. The bearing 8 surrounds the forward leg 22 with a self-lubricating sleeve 78 positioned between the bearing and the forward leg. The sleeve 78 provides a tight fitting engagement between the bearing 8 and forward leg 22 such that, in effect, the sleeve is squeezed between the bearing and forward leg. The sleeve 78 may be made of any suitable material such as, for example, a fluorocarbon resin as sold under the trademark TEFLON by E. I. DuPont de Nemours & Co.

The bottom end of the bearing 8 may be crimped at point 80 to prevent axial movement of the sleeve 78 within the bearing. A stud 76 extending through the forward leg 22 has supporting heads 77 at either end of the stud. The enlarged supporting heads 77 bear against the lower surface of the bearing 8 to prevent downward movement of the bearing 8 with respect to the forward leg 22. As illustrated, the bearing 8 may also be crimped at a point 82 adjacent its upper end to prevent upward movement of the sleeve 78 within the bearing. Generally, however, this is not necessary since the upper edge of the bearing 8 bears against the undersurface of the upper brace 28 with the upper brace preventing upward movement of either the bearing or the self-lubricating sleeve 78 within the bearing.

The self-lubricating sleeve 78 is relatively long in its axial dimension to provide a large contact area with the outer surface of the forward leg 22 and the inner surface of the bearing 8. For ease of installation, the sleeve 78 may be cut with the cut edges abutting each other when the sleeve is inserted within the bearing 8. Due to the absence of metal-to-metal contact between the outer surface of the forward leg 22 and the inner surface of the bearing 8, coupled with the self-lubricating properties of the sleeve 78, the wear at the pivotal supports for the gate legs is reduced to an absolute minimum. Thus, even after long usage, the pivotal inter-connection between the gate legs 6 and the cross brace 4 remains tight to provide firm and stable support for an aged or incapacitated person using the walker.

I claim:

1. A collapsable walker comprising:

a cross brace having a bearing at each of its extremities;

a pair of gate legs with one of said gate legs being pivotally mounted in each of said bearings for rotation between an open position with the gate legs positioned generally transversely of the cross brace and a collapsed position with the gate legs folded against the cross brace;

corner braces connected adjacent each of said bearings;

said corner braces each being connected to one of said gate legs and to said cross brace to provide rigid bracing support between the gate legs and the cross brace when the gate legs are in an open position, and said corner braces being movable to permit rotation of the gate legs to a collapsed position.

2. The collapsible walker of claim 1 wherein;

each of said corner braces is pivotally mounted on one of said gate legs;

each of said corner braces is movable with respect to said cross brace during movement of the gate legs to a collapsed position, and each of said corner braces is interlocked with said cross brace when said gate legs are in an open position.

3. The collapsible walker of claim 2 wherein:

each of said corner braces acts as a strut between a gate leg and the cross brace when the gate legs are in an open position to provide triangular three point support for each gate leg.

4. The collapsible walker of claim 2, including:

a guide slot in each of said corner braces;

guide pins positioned on said cross brace in engagement with said guide slots, and said guide slots being shaped to move the corner braces to an interlocking position with said cross brace as the gate legs are moved to an open position and to move the corner braces to a recessed position adjacent the cross brace as the gate legs are moved to a collapsed position.

5. The collapsible walker of claim 1 including frictional means positioned to resist the movement of the gate legs between an open and a collapsed position, whereby the walker may be transported and moved about with the gate legs in a collapsed position without their accidental movement to an open position.

6. The collapsible walker of claim 1 wherein said bearings include a self-lubricating plastic sleeve and a tubular member on each of said gate legs mounted within said plastic sleeve.

7. The collapsible walker of claim 1 wherein the gate legs and cross brace provide an unobstructed open space with the gate legs in an open position such that the walker can be used as a toilet assist.

8. The collapsible walker of claim 6 wherein each of said plastic sleeves is held within a tubular metallic member included within said cross brace.

9. The collapsible walker of claim 8 wherein each of said tubular metallic members is crimped to provide a reduced diameter portion which engages the plastic sleeve to hold the plastic sleeve within the tubular metallic member.

10. The collapsible walker of claim 9 wherein each of the tubular metallic members is crimped adjacent each end of the plastic sleeve to hold the plastic sleeve with respect to the tubular metallic member.

11. The collapsible walker of claim 9 wherein each of the tubular metallic members is crimpled adjacent the lower end of the plastic sleeve to hold the plastic sleeve with respect to the tubular metallic member.

12. The collapsible walker of claim 8 wherein said cross brace is positioned at a height to provide clearance between the cross brace and a toilet bowl when the walker is moved over the toilet bowl with the gate legs positioned on either side of the bowl.

13. A collapsable walker comprising:

a cross brace having a bearing at each of its extremities;

a pair of gate legs with one of said gate legs being pivotally mounted in each of said bearings for rotation between an open position with the gate legs positioned generally transversely of the cross brace and in a collapsed position with the gate legs folded against the cross brace;

corner braces positioned adjacent each of said bearings;

said corner braces each being connected to one of said gate legs and to said cross brace to provide rigid bracing support between the gate legs and the cross brace when the gate legs are in an open position;

said corner braces being movable to permit rotation of the gate legs to a collapsed position;

each of said corner braces being pivotally mounted on one of said gate legs;

each of said corner braces being movable with respect to said cross brace during movement of the gate legs to a collapsed position;

each of said corner braces being interlocked with said cross brace when said gate legs are in an open position;

detents supported by said cross brace in engagement with said corner braces;

apertures in said corner braces positioned to receive said detents when the gate legs are in an open position, and means to move the detents out of the apertures in unlocking the corner braces from the cross brace for movement of the gate legs to a collapsed position.

14. The collapsible walker of claim 13 wherein said means to move the detents out of the apertures includes a release tab having a relatively large, easily accessible pushing surface which may be actuated by a handicapped or aged person who lacks fine muscular coordination.

15. The collapsible walker of claim 13 wherein said detents are biased upwardly against said corner braces with the detents sliding against the undersides of the corner braces during movement of the gate legs between an open and a collapsed position.

16. The collapsible walker of claim 13 wherein the surfaces of said detents which engage said apertures are shaped to provide self-centering of the detents with respect to the apertures when the gate legs are in an open position.

17. The collapsible walker of claim 16 wherein each of said detents has a conical outer surface and each of said apertures having a circular opening, whereby the contact surface area presented by said detents increases or decreases in relation to the degree of movement of said detents into said apertures.

18. The collapsible walker of claim 14 wherein said release tabs are secured to each of said corner braces and are positioned over said apertures.

* * * * *